US007173999B2

(12) United States Patent
Buijsse

(10) Patent No.: US 7,173,999 B2
(45) Date of Patent: Feb. 6, 2007

(54) X-RAY MICROSCOPE HAVING AN X-RAY SOURCE FOR SOFT X-RAY

(75) Inventor: Bart Buijsse, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 820 days.

(21) Appl. No.: 09/741,672

(22) Filed: Dec. 19, 2000

(65) Prior Publication Data

US 2003/0219097 A1 Nov. 27, 2003

(30) Foreign Application Priority Data

Dec. 20, 1999 (EP) ..... 99204402

(51) Int. Cl.
*G21K 7/00* (2006.01)

(52) U.S. Cl. ..... 378/43; 378/143

(58) Field of Classification Search ..... 378/43, 378/119, 121, 122, 143; 250/310, 504 R
See application file for complete search history.

(56) References Cited

U.S. PATENT DOCUMENTS 4,723,262 A * 2/1988 Noda et al. ..... 378/119
4,953,191 A * 8/1990 Smither et al. ..... 378/143
5,044,001 A * 8/1991 Wang ..... 378/43
5,835,262 A * 11/1998 Iketaki et al. ..... 359/352
6,002,744 A * 12/1999 Hertz et al. ..... 378/119

FOREIGN PATENT DOCUMENTS

WO W09740650 10/1997

OTHER PUBLICATIONS

Berglund et al., "Cryogenic liquid-jet target for debris-free laser-plasma soft x-ray generation", published in Rev. Sci. Instrum., vol. 69, p. 2361, 1998.*

* cited by examiner

*Primary Examiner*—Edward J. Glick
*Assistant Examiner*—Jurie Yun

(57) ABSTRACT

Soft X-rays are very suitable for the examination of biological samples by means of an X-ray microscope. The X-rays are generated by focusing an electron beam onto a fluid jet, thus producing a very small electron focus on the jet and hence a very small monochromatic X-ray spot. The electron spot can be obtained by means of a standard electron microscope (a SEM) or by means of a standard electron gun for a cathode ray tube (a CRT gun). The imaging optical elements in the X-ray microscope may be Fresnel zone plates.

7 Claims, 4 Drawing Sheets

X-RAY MICROSCOPE HAVING AN X-RAY SOURCE FOR SOFT X-RAY

BACKGROUND OF THE INVENTION

The invention relates to an X-ray microscope which includes a device for generating X-rays, which device is provided with:

means for producing a fluid jet, means for forming a focused radiation beam whose focus is situated on the fluid jet.

A device for generating soft X-rays is known from the published patent application WO 97/40650 (PCT/SE 97/00697). The means for producing a fluid jet in the known device are formed by a nozzle wherefrom a fluid such as water is ejected under a high pressure. The means for producing a focused radiation beam are formed by a combination of a pulsating laser and a focusing lens which focuses the pulsating radiation beam produced by the laser in such a manner that the focus is situated on the fluid jet. Because of the high power density of the laser pulses, the laser light thus induces a plasma in the fluid jet, thus generating said soft X-rays. The cited patent application describes how these X-rays, notably those of a wavelength of 2.3–4.4 nm, can be used for X-ray microscopy.

Generating X-rays by way of pulsed laser plasma emission has a number of drawbacks.

A first drawback in this respect is due to the fact that it is necessary to operate the laser in the pulsating mode in order to achieve an adequate power density of the laser. The cited patent application mentions a power density of from $10^{13}$–$10^{15}$ W/cm$^2$ ; if this power is to be generated by means of a laser in continuous operation, an extremely large laser would be required. As a result, this known X-ray source produces only X-rays of a pulsating nature.

A further drawback of laser-induced plasma emission consists in the phenomenon that many particles (molecules, radicals, atoms (ionized or not), which usually have a high kinetic energy and may be very reactive chemically are present in the vicinity of the location where the X-rays are formed (the X-ray spot). The formation of these particles can be explained as follows: when energy is applied to the target (so the fluid jet) by means of laser light, as the intensity increases first the electrons of the outer shell of the target material will be ionized whereas the electrons of the inner shells, producing the X-rays, are excited only after that. The particles then formed could damage the sample to be examined by means of the X-ray microscope. In order to mitigate or prevent such damage, it is feasible to arrange an optical intermediate element (for example, a condenser lens in the form of a Fresnel zone plate) between the physical X-ray spot and the actually desired location of the X-ray spot, thus creating an adequate distance between the X-ray spot and the sample without seriously affecting the imaging properties of the X-ray microscope. Because condenser lenses are not very effective in the X-ray field, however, a considerable part of the X-ray power generated for the imaging in the X-ray microscope is thus lost. Moreover, some other types of condensers (for example, multilayer mirrors or grazing incidence mirrors) are very susceptible to damage by said high energetic particles.

SUMMARY OF THE INVENTION

It is an object of the invention to avoid said drawbacks by providing an X-ray source for comparatively soft X-rays which can operate continuously while forming no or hardly any detrimental particles in the X-ray target. This object is achieved according to the invention in that the focused radiation beam consists of a beam of electrically charged particles. The above-mentioned drawbacks are avoided by irradiating the fluid jet by means of said particles. Because of the much shorter wavelength of said particles, moreover, an advantage is obtained in that the focus formed by means of said particles can be much smaller than the focus of the beam of laser light. The invention offers an additional advantage in that the energy of the electrically charged particles can be continuously controlled in a wide range by variation of the acceleration voltage of said particles; such control is realized by variation of the acceleration voltage of these particles.

The beam of electrically charged particles is formed by an electron beam in a preferred embodiment of the invention. This embodiment offers the advantage that use can be made of existing apparatus such as a scanning electron microscope. Such apparatus is arranged notably to obtain a very small electron focus, that is, a focus with a diameter as small as a few nanometers.

The cross-section of the fluid jet in the direction of the focused beam in a further embodiment of the invention is smaller than that in the direction transversely thereof. This embodiment is of importance in all cases where the particle beam has a width which is larger than approximately the penetration depth into the fluid jet. If a fluid jet having a circular cross-section were used in such circumstances, the X-rays generated in a comparatively thin region at the surface of the jet would be absorbed in the interior of the fluid jet again, so that a useful yield of the X-rays would be lost. This adverse effect is strongly mitigated or even avoided when a "flattened" fluid jet is used.

The fluid jet in another embodiment of the invention consists mainly of liquid oxygen or nitrogen. In addition to the advantage that a fluid jet of a liquefied gas has excellent cooling properties, and hence can be exposed to heavy thermal loading, such a fluid jet also has a high degree of spectral purity, notably in the range of soft X-rays, that is, in the so-called water window (wavelength $\lambda$=2.3–4.4 nm). This wavelength range is particularly suitable for the examination of biological samples by means of an X-ray microscope, because the absorption contrast between water and carbon is maximum in this range.

The means for producing a focused beam of electrically charged particles in another embodiment of the invention are formed by a standard electron gun for a cathode ray tube, the X-ray microscope also being provided with a condenser lens which is arranged between the fluid jet and the object to be imaged by means of the X-ray microscope. According to the invention a first advantage of the use of a standard electron gun of a cathode ray tube resides in the fact that such elements already are manufactured in bulk and have already proven their effectiveness for many years. Another advantage resides in fact that such electron sources are capable of delivering a comparatively large current (of the order of magnitude of 1 mA). The electron spot, however, has a dimension of the order of magnitude of 50 μm, being of the same order of magnitude as the dimensions of the object to be imaged, so that in this case a condenser lens is required which concentrates the radiation from the X-ray spot onto the sample. Even though X-ray intensity is lost due to the use of the condenser, the current in the electron beam is so large that this loss is more than compensated for.

The properties that can be offered by an existing electron microscope so as to implement the invention can be used to good advantage. An electron microscope produces a focused electron beam and may be provided with a device for generating X-rays which is characterized according to the invention in that it is provided with means for producing a fluid jet and means for directing the focus of the electron beam onto the fluid jet. An X-ray microscope can thus be incorporated in the electron microscope, the device for generating X-rays then acting as an X-ray source for the X-ray microscope. Notably a scanning electron microscope is suitable for carrying out the present invention, because such a microscope can readily operate with acceleration voltages of the electron beam which are of the order of magnitude of from 1 to 10 kV; these values correspond to values necessary so as to generate soft X-rays in the water window.

BRIEF DESCRIPTION OF THE DRAWING

Exemplary embodiments of the invention will be described in detail hereinafter with reference to the Figures; corresponding elements therein are denoted by corresponding reference numerals. Therein.

DESCRIPTION OF EXEMPLARY EMBODIMENTS

Figure 1C:
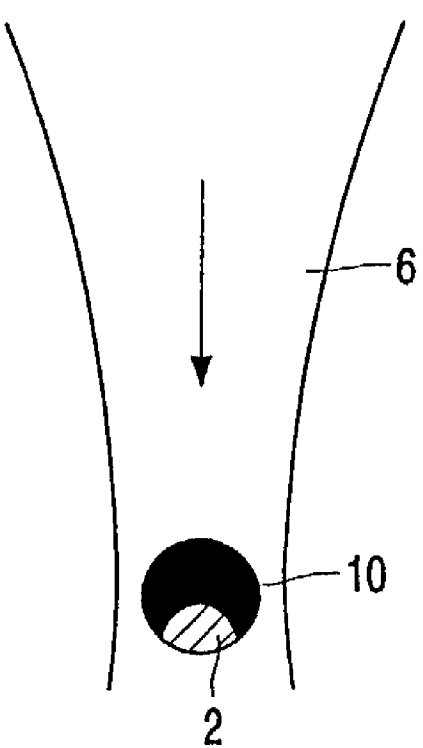
FIG. 1 shows diagrammatically some configurations of an electron beam with a fluid jet for the purpose of comparison.
Figure 1B:
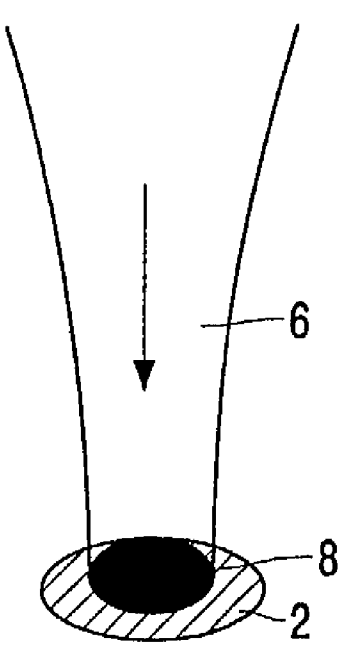
Figure 1A:
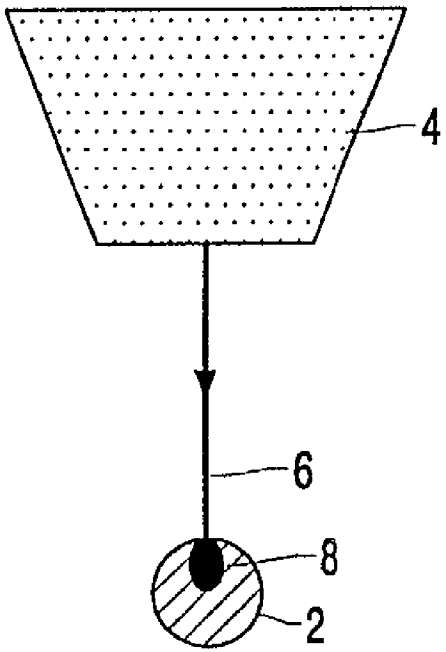

The FIGS. 1*a* to 1*c* show a number of configurations in which a fluid jet which is assumed to extend perpendicularly to the plane of drawing is irradiated by an electron beam. In FIG. 1*a* this beam originates from a spot forming objective of a scanning electron microscope (SEM); in the FIGS. 1 and *b* the electron beam originates from a standard electron gun for a cathode ray tube (CRT gun).

In FIG. 1*a* the fluid jet 2, for example a jet of water, has a diameter of approximately 10 μm. The electron beam 6 focused onto the fluid jet by the objective 4 of the SEM is subject to an acceleration voltage of, for example, 10 kV and transports a current of, for example, 5 μA. An electron spot having a cross-section of 1 μm generates an X-ray spot having a dimension of approximately 2 μm with soft X-rays and a wavelength of $\alpha$=2.4 nm with a weak background of Bremsstrahlung in a region 8. The surrounding water still has a monochromatizing effect and will suitably transmit the line with the wavelength of 2.4 nm, but will strongly absorb the Bremsstrahlung of a higher energy. The soft X-rays thus obtained can be used so as to irradiate an object to be imaged in an X-ray microscope.

In FIG. 1*b* the fluid jet 2 is irradiated by an electron beam 6 which originates from a standard CRT gun (not shown). In this case the fluid jet 2 has an elliptical cross-section with a height of, for example, 20 μm and a width of, for example, 100 μm. The electron beam 6 focused onto the fluid jet by the CRT gun produces an electron spot 8 having a cross-section of approximately 50 μm. The electron beam is subject to an acceleration voltage of, for example, 30 kV and transports a current of, for example, 1 mA. As is the case in FIG. 1*a*, the surrounding water has a monochromatizing effect on the soft X-rays generated.

When an elliptical fluid jet of the above (comparatively large) dimensions of 20×100 μm is used, it may occur that the vacuum system cannot adequately discharge the vapor produced by the jet, so that the pressure in the system could become too high for the use of an electron gun. In such cases use can be made of the configuration shown in FIG. 1*c* in which the fluid jet 2 is also irradiated by an electron beam 6 which originates from a standard CRT gun (not shown). The cross-section of the electron beam again amounts to 50 μm, but in this case the fluid jet 2 has a circular cross-section of the order of magnitude of, for example, 10 μm. As a result of this configuration, the X-ray spot 10 has a dimension which is not larger than the cross-section of the fluid jet, that is, 10 μm in this case.

Figure 2:
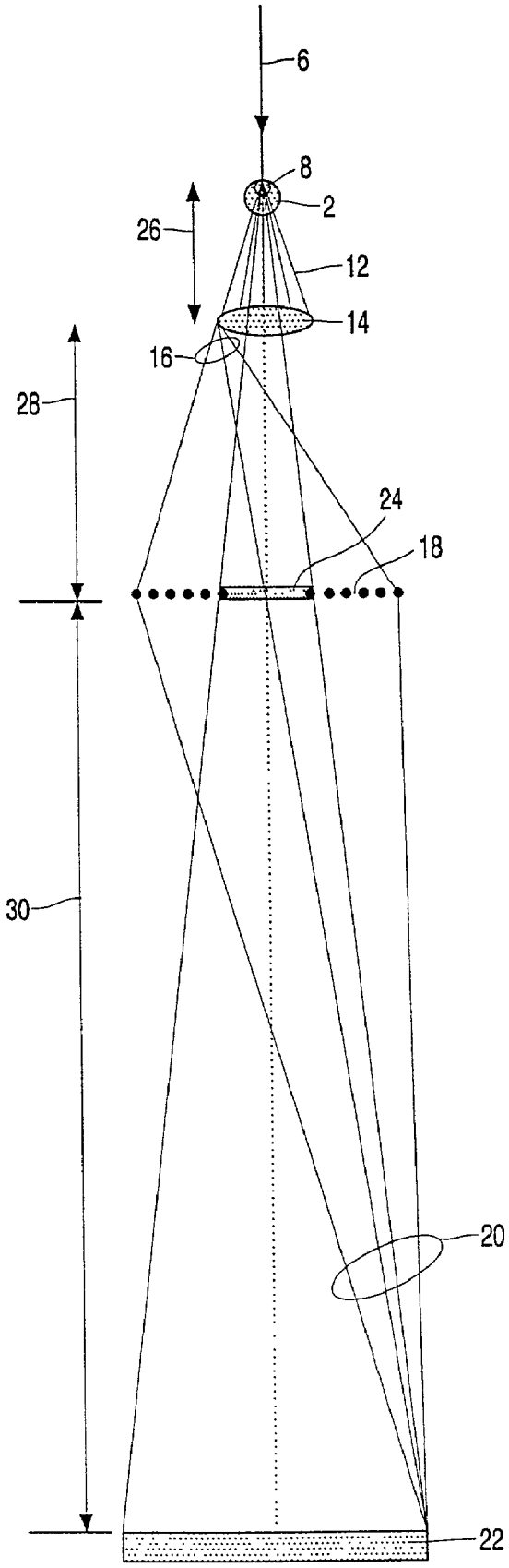
FIG. 2 shows diagrammatically the beam path in a transmission X-ray microscope according to an embodiment of the invention.

FIG. 2 shows diagrammatically the beam path in a transmission X-ray microscope according to the invention. In a transmission X-ray microscope the image is formed by irradiating the object to be imaged (the sample) more or less uniformly by means of X-rays, the object thus irradiated being imaged by means of a projecting objective lens which is in this case formed by a Fresnel zone plate. A Fresnel zone plate is a dispersive element. This could give rise to imaging defects which limit the resolution and are, of course, undesirable. Thus, it is necessary for the irradiating X-ray source to be as monochromatic as possible; this requirement is more than adequately satisfied by the X-ray source according to the invention.

In the configuration shown in FIG. 2 it is assumed that the X-ray source is formed by an electron spot 8 which itself is formed in a fluid jet 2 by an electron beam 6 which originates from a SEM system, the flow direction of said fluid jet 2 extending perpendicularly to the plane of drawing. In this case the electron spot, and hence the X-ray spot, is (much) smaller than the cross-section of the fluid jet. The X-ray beam 12 originating from the electron / X-ray spot 8 more or less uniformly irradiates the object 14 to be imaged by means of the X-ray microscope. The object 14 is situated at a distance 26 of, for example, 150 μm from the X-ray spot. X-rays are scattered by the object 14 as represented by a sub-beam 16 of scattered X-rays. Each irradiated point-shaped area of the object produces such a sub-beam. The sub-beams thus formed are incident on the objective 18 which has a typical focal distance of 1 mm and a typical diameter of 100 μm. The objective images the relevant point on the image plane 22 via the sub-beam 20. When the object distance 28 is then equal to 1.001 mm and the image distance equals 1000 mm, the magnification is 1000× for the given focal distance of 1 mm. In order to prevent the X-ray spot 8 which irradiates through the object 14 from being imaged by the objective 18 in the space between the objective and the image plane 22, thus overexposing the image in the image plane, an X-ray absorbing shielding plate 24 is arranged at the center of the objective.

A detector which is sensitive to the X-rays of the relevant wavelength is arranged in the image plane 22. For this purpose use can be made of an X-ray-sensitive CCD camera whose detector surface is coincident with the image plane 22. An example of such a CCD camera is a CCD camera of the so-called "back illuminated" type such as the camera type NTE/CCD-1300 EB from "Princeton Instruments", a "Roper Scientific" company.

Figure 3:
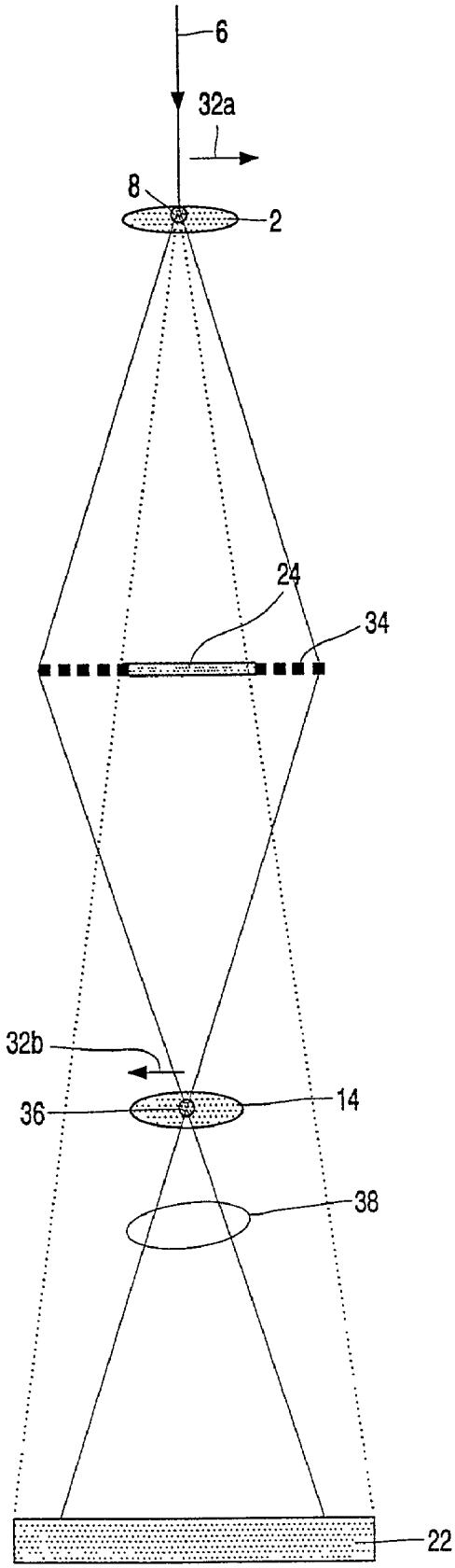
FIG. 3 shows diagrammatically the beam path in a scanning transmission X-ray microscope according to an embodiment of the invention.

FIG. 3 is a diagrammatic representation of the beam path in a scanning transmission X-ray microscope according to the invention. In a scanning transmission X-ray microscope the image is formed by scanning the object to be imaged in conformity with a given scanning pattern, that is, with a reduced image of the X-ray spot or not, and by detecting the X-rays scattered by the object as a function of the location on the object irradiated by the image of the X-ray spot. The image of the X-ray spot is then obtained by means of an objective lens. When this lens is formed as Fresnel zone plate, the irradiating X-ray source should again be as monochromatic as possible.

For the configuration shown in FIG. 3 it is assumed again that the X-ray source is formed by an X-ray spot 8 which is formed in a fluid jet 2 by an electron beam 6 originating from a SEM system, the flow direction of said jet extending perpendicularly to the plane of drawing. The electron spot, and hence the X-ray spot, is (much) smaller than the cross-section of the fluid jet. In this case the width of the fluid jet in the direction perpendicular to the electron beam is much greater than that in the direction of the electron beam, for example, it has a width of 100 μm and a height of 20 μm. The electron beam 6 is scanned across the fluid jet in the longitudinal direction 32*a*, for example, by means of the standard scan coils in a SEM. As a result, the X-ray spot thus produced moves in the same way. The objective lens 34 formed by the Fresnel zone plate is arranged in such a manner that it images the X-ray spot 8 formed in the fluid jet on the object 14. Due to said displacement of the X-ray spot in the direction 32*a*, the image 36 thereof which is formed on the object is also displaced, that is, in the direction of the arrow 33*b* which opposes the direction 32*a* due to the lens effect of the objective 34. The X-rays 38 scattered by the object are detected again by the detector 22 and, like in the configuration shown in FIG. 2, an X-ray absorbing shielding plate 24 is arranged in the objective so as to prevent the X-ray spot 8 from coming into sight of the detector 22.

Figure 4:
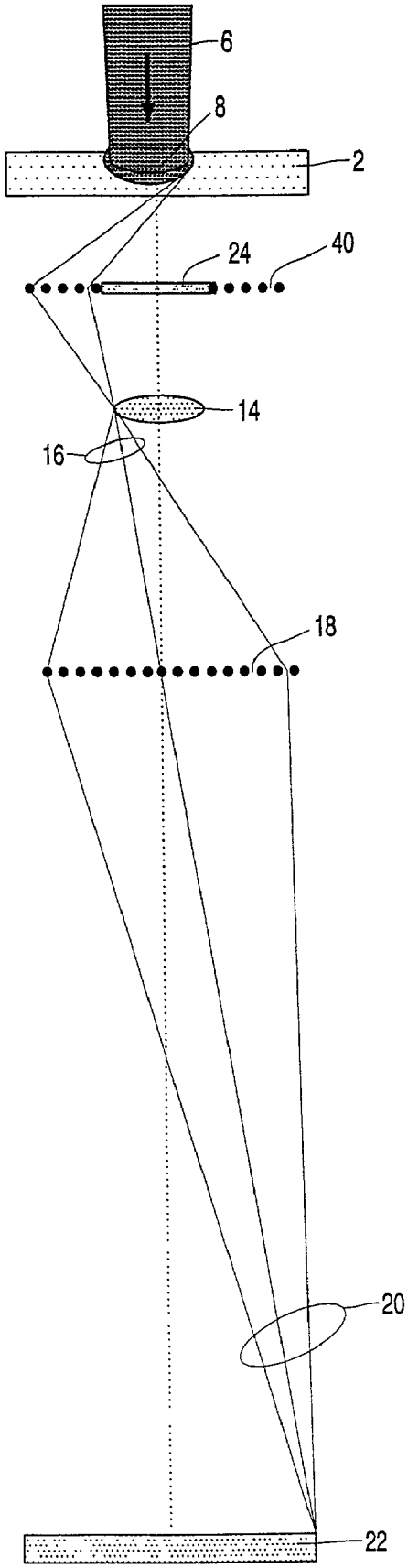
FIG. 4 shows diagrammatically the beam path in a transmission X-ray microscope provided with a standard electron gun for a cathode ray tube in accordance with an embodiment of the invention.

FIG. 4 shows diagrammatically the beam path in a transmission X-ray microscope in which the electron source generating the X-rays is formed by a standard electron gun (not shown) for a cathode ray tube which is capable of delivering a beam current of the order of magnitude of 1 mA. The configuration shown in FIG. 4 is mainly identical to that shown in FIG. 2, except for the already mentioned difference concerning the electron source and the presence of a condenser lens 40 in FIG. 4. Because the X-ray spot 8 in this configuration has dimensions of the same order of magnitude as the object 14 (for example, from 50 to 100 μm), the condenser lens 40 is provided in the form of a Fresnel zone plate 40. The condenser lens 40 images the X-ray spot 8 on the object 14 in reduced form; the entire further imaging process is the same as already described with reference to FIG. 2.

The invention claimed is:

1. An X-ray microscope which includes a device for generating X-rays, a lens for forming an image of an object, and an X-ray detector for detecting an image of the object, the device for generating X-rays provided with:

means for producing a fluid jet having a curvilinear cross-section, means for forming a focused radiation beam whose focus is situated on the fluid jet, said focused radiation beam comprising a beam of electrically charged particles, wherein the cross-section of the fluid jet in the direction of the focused beam is smaller than that in the direction transversely thereof.

2. An X-ray microscope as claimed in claim 1, wherein the beam of electrically charged particles comprises an electron beam.

3. An X-ray microscope as claimed in claim 1, wherein the fluid jet consists essentially of liquid oxygen or nitrogen.

4. An X-ray microscope as claimed in claim 1, wherein the means for producing a focused beam of electrically charged particles comprises an electron gun for a cathode ray tube, the X-ray microscope including a condenser lens disposed between the fluid jet and an object to be imaged by means of the X-ray microscope.

5. An electron microscope comprising means for producing a focused electron beam, a device for generating X-rays, a lens for forming an image of an object, and a detector for detecting the image of the object, said device for generating X-rays including:

means for producing a fluid jet having a curvilinear cross-section, and means for directing the focus of the electron beam onto the fluid jet, wherein the cross-section of the fluid jet in the direction of the focused beam is smaller than that in the direction transversely thereof.

6. An electron microscope as claimed in claim 5 and including an X-ray microscope, said device for generating X-rays acting as the X-ray source for the X-ray microscope.

7. An electron microscope as claimed in claim 5, the electron microscope being a scanning electron microscope.

* * * * *